US009966013B2

(12) United States Patent
Park et al.

(10) Patent No.: US 9,966,013 B2
(45) Date of Patent: May 8, 2018

(54) DISPLAY APPARATUS INCLUDING A BACKLIGHT AND METHOD OF THE DRIVING DISPLAY APPARATUS

(71) Applicant: SAMSUNG DISPLAY CO., LTD., Yongin-si, Gyeonggi-Do (KR)

(72) Inventors: Munsan Park, Yongin-si (KR); Jungtaek Kim, Yongin-si (KR); Jaihyun Koh, Yongin-si (KR); Junghwan Cho, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 126 days.

(21) Appl. No.: 15/200,574

(22) Filed: Jul. 1, 2016

(65) Prior Publication Data

US 2017/0193925 A1 Jul. 6, 2017

(30) Foreign Application Priority Data

Dec. 31, 2015 (KR) ..... 10-2015-0190776

(51) Int. Cl.
*G09G 3/36* (2006.01)
*G09G 3/34* (2006.01)

(52) U.S. Cl.
CPC ..... *G09G 3/3406* (2013.01); *G09G 3/3648* (2013.01); *G09G 2320/0626* (2013.01); *G09G 2320/0666* (2013.01)

(58) Field of Classification Search
CPC ... G09G 3/36; G09G 5/10; G09G 5/00; F21V 7/04; G06K 9/00; G06F 3/038
See application file for complete search history.

(56) References Cited

U.S. PATENT DOCUMENTS

2005/0134800 A1* 6/2005 Kim ..... H04N 9/68 351/242
2007/0236556 A1* 10/2007 Wu ..... B41J 2/47 347/253

(Continued)

FOREIGN PATENT DOCUMENTS

KR 10-2005-0044114 5/2005
KR 10-2007-0084278 8/2007

(Continued)

OTHER PUBLICATIONS

Gustavo M. Machado, et al., "A Physiologically-Based Model for Simulation of Color Vision Deficiency," IEEE Transactions on Visualization and Computer Graphics, vol. 15, No. 6, Nov./Dec. 2009, pp. 1291-1298.

*Primary Examiner* — Pegeman Karimi
(74) *Attorney, Agent, or Firm* — F. Chau & Associates, LLC

(57) ABSTRACT

A display apparatus includes an image data receiver receiving image data of an image to be displayed. A driving mode determining controller receives anomalous trichromat data of a user, determines a driving mode as either a general driving mode or an anomalous trichromat correction driving mode, and outputs a driving mode signal indicative of the determination. A correction mode requirement luminance calculator calculates a correction mode requirement luminance for an image output for the user. A backlight boosting determination controller determines a level of boosting light emitted from a backlight, and outputs a boosting determine signal. An image data converter converts image data corresponding to the anomalous trichromat data of the user and the correction mode requirement luminance, and outputs a data signal corresponding to correction image data. The (Continued)

backlight emits light having an intensity corresponding to signals. A pixel transmits light according to the data signal.

20 Claims, 6 Drawing Sheets

(56) References Cited

U.S. PATENT DOCUMENTS

| | | | | |
|---|---|---|---|---|
| 2007/0236656 | A1* | 10/2007 | Jeong | H04N 9/68 351/159.24 |
| 2009/0135266 | A1 | 5/2009 | Raaymakers et al. | |
| 2013/0241970 | A1* | 9/2013 | Lee | G09G 3/3225 345/690 |
| 2014/0015850 | A1* | 1/2014 | Ahn | H04N 1/60 345/594 |
| 2016/0071470 | A1 | 3/2016 | Kim et al. | |

FOREIGN PATENT DOCUMENTS

| | | |
|---|---|---|
| KR | 10-2007-0099969 | 10/2007 |
| KR | 10-2013-0105057 | 9/2013 |
| KR | 10-2014-0008977 | 1/2014 |
| KR | 10-2016-0030005 | 3/2016 |

* cited by examiner

FIG. 3

| LEVEL OF ANOMALOUS TRICHROMAT | PROTANOMALY | | | DEUTERNOMALY | | |
|---|---|---|---|---|---|---|
| | R | G | B | R | G | B |
| 0.0000 | 1.000 | 0.000 | 0.000 | 1.000 | 0.000 | 0.000 |
| | 0.000 | 1.000 | 0.000 | 0.000 | 1.000 | 0.000 |
| | 0.000 | 0.000 | 1.000 | 0.000 | 0.000 | 1.000 |
| 0.1000 | 1.176 | −0.224 | 0.048 | 1.167 | −0.221 | 0.054 |
| | −0.036 | 1.054 | −0.018 | −0.062 | 1.077 | −0.015 |
| | 0.003 | 0.001 | 0.996 | 0.004 | −0.009 | 1.004 |
| 0.2000 | 1.398 | −0.509 | 0.111 | 1.374 | −0.495 | 0.121 |
| | −0.079 | 1.117 | −0.037 | −0.140 | 1.175 | −0.035 |
| | 0.006 | 0.002 | 0.991 | 0.010 | −0.019 | 1.009 |
| 0.3000 | 1.685 | −0.880 | 0.195 | 1.639 | −0.843 | 0.204 |
| | −0.131 | 1.192 | −0.060 | −0.243 | 1.305 | −0.062 |
| | 0.009 | 0.004 | 0.987 | 0.018 | −0.031 | 1.014 |
| 0.4000 | 2.071 | −1.381 | 0.310 | 1.991 | −1.304 | 0.313 |
| | −0.198 | 1.286 | −0.088 | −0.382 | 1.482 | −0.100 |
| | 0.012 | 0.005 | 0.982 | 0.028 | −0.047 | 1.019 |
| 0.5000 | 2.614 | −2.090 | 0.476 | 2.481 | −1.945 | 0.464 |
| | −0.288 | 1.410 | −0.122 | −0.579 | 1.734 | −0.156 |
| | 0.014 | 0.008 | 0.978 | 0.042 | −0.069 | 1.026 |
| 0.6000 | 3.433 | −3.162 | 0.729 | 3.213 | −2.900 | 0.687 |
| | −0.417 | 1.587 | −0.170 | −0.877 | 2.118 | −0.242 |
| | 0.016 | 0.011 | 0.973 | 0.064 | −0.100 | 1.036 |
| 0.7000 | 4.803 | −4.962 | 1.158 | 4.429 | −4.484 | 1.055 |
| | −0.627 | 1.870 | −0.243 | −1.378 | 2.765 | −0.388 |
| | 0.016 | 0.017 | 0.967 | 0.101 | −0.150 | 1.049 |
| 0.8000 | 7.552 | −8.579 | 2.028 | 6.856 | −7.640 | 1.784 |
| | −1.037 | 2.417 | −0.380 | −2.385 | 4.071 | −0.686 |
| | 0.011 | 0.028 | 0.961 | 0.175 | −0.249 | 1.074 |
| 0.9000 | 15.812 | −19.468 | 4.656 | 14.124 | −17.085 | 3.961 |
| | −2.247 | 4.020 | −0.772 | −5.420 | 8.009 | −1.589 |
| | −0.009 | 0.061 | 0.949 | 0.398 | −0.541 | 1.144 |

DISPLAY APPARATUS INCLUDING A BACKLIGHT AND METHOD OF THE DRIVING DISPLAY APPARATUS

CROSS-REFERENCE TO RELATED APPLICATION

This application claims priority under 35 U.S.C. § 119 to Korean Patent Application No. 10-2015-0190776, filed on Dec. 31, 2015, in the Korean Intellectual Property Office, the disclosure of which is incorporated by reference herein in its entirety.

1. TECHNICAL FIELD

One or more exemplary embodiments of the present inventive concept relate to a display apparatus, and more particularly, to a display apparatus including a backlight and a method of driving the display apparatus.

2. DISCUSSION OF RELATED ART

In general, color blindness denotes a condition by which a person is incapable of differentiating colors normally due to a congenital functional irregularity of one or more sets of retinal cone cells, damage that was acquired in the retina cone cell, or an irregularity of the visual pathway for light to travel to the retinal cone cells in their eyes. A trichromat, or an individual with normal color vision, has vision capable of detecting a combination of three single colors of light which are the color red, the color green, and the color blue. In the retina of the eye there are three types of cone cells with each cell corresponding to different wavelengths of light (wavelengths corresponding to the colors of red, green, and blue).

When one of the three cone cells (red, green, and blue) functions improperly, the condition is referred to as anomalous trichromacy, and when an individual only has two properly functioning cone cells, the condition is referred to as achromatopsia. An individual who is color blind, for example an individual diagnosed with either anomalous trichromacy or achromatopsia, is referred to as having color vision deficiency.

Individuals who have color vision deficiency might not be able to differentiate between more than two colors. Individuals with a color vision deficiency may obtain help in differentiating colors by using an image in which a contrast of colors is enhanced. Research has been conducted to apply such a method to a display apparatus displaying an image or a picture.

SUMMARY

One or more exemplary embodiments of the present inventive concept include a display apparatus including a backlight in which luminance might not be reduced while an image for a user with color vision deficiency is displayed, a display control apparatus, and a method of displaying.

Additional exemplary embodiments of the present inventive concept will be set forth, in part, in the description which follows and, in part, will be apparent from the description.

According to one or more exemplary embodiments of the present inventive concept, a display apparatus includes an image data receiver receiving image data of an image to be displayed, and a driving mode determining controller receiving anomalous trichromat data of a user, determining a driving mode as either a general driving mode or an anomalous trichromat correction driving mode, based on the anomalous trichromat data of the user, and outputting a driving mode signal indicative of the determination. Included in the display apparatus is a correction mode requirement luminance calculator calculating a correction mode requirement luminance for an image output for the user. The correction mode requirement luminance corresponds to the anomalous trichromat data of the user and the image data. Included in the display apparatus is a backlight boosting determination controller determining a level of boosting light emitted from a backlight, corresponding to the correction mode requirement luminance, and outputting a boosting determine signal. An image data converter converts image data corresponding to the anomalous trichromat data of the user and the correction mode requirement luminance, and outputs a data signal corresponding to correction image data. The backlight emits light having an intensity corresponding to the driving mode signal and the boosting determine signal. A pixel transmits a quantity of light according to the data signal.

According to one or more exemplary embodiments of the present inventive concept, a method of driving the display apparatus includes receiving image data of an image to be displayed, receiving anomalous trichromat data of a user, determining a driving mode as either a general driving mode or an anomalous trichromat correction driving mode, based on the anomalous trichromat data of the user, outputting a driving mode signal indicative of the determination, and calculating a correction mode requirement luminance for an image output for the user. The correction mode requirement luminance corresponding corresponds to the anomalous trichromat data of the user and the image data. The method further includes determining the level of boosting light emitted from a backlight, corresponding to the correction mode requirement luminance, outputting a boosting determine signal, converting image data corresponding to the anomalous trichromat data of the user and the correction mode requirement luminance, and outputting a data signal corresponding to correction image data.

BRIEF DESCRIPTION OF THE DRAWINGS

The above and other features of the inventive concept will become more apparent by describing in detail exemplary embodiments thereof, with reference to the accompanying drawing, in which:

FIG. 3 is a table of a correction matrix according to an exemplary embodiment of the inventive concept;

DETAILED DESCRIPTION

Figure 1:
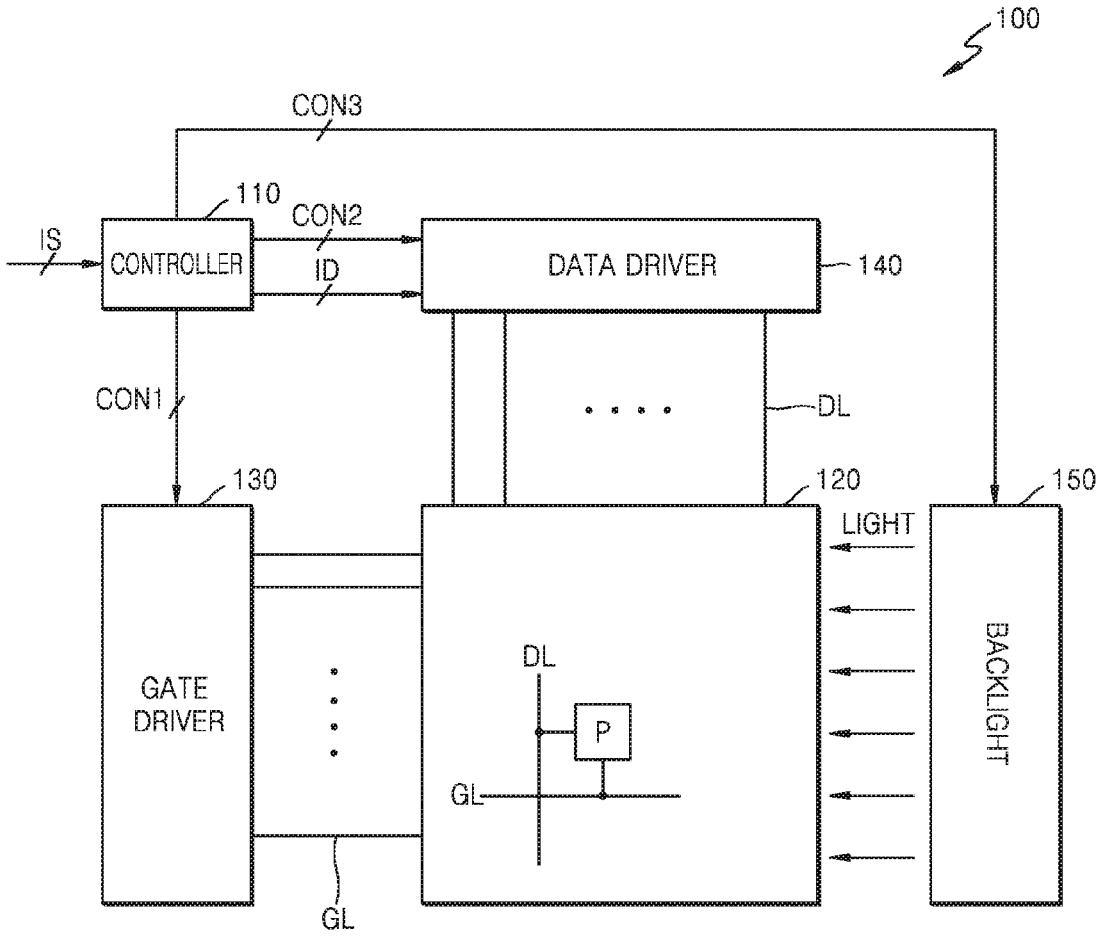
FIG. 1 is a block diagram of a display apparatus according to an exemplary embodiment of the inventive concept.

Reference will now be made in detail to exemplary embodiments of the present inventive concept, examples of which are illustrated throughout the specification and in the accompanying drawings, wherein like reference numerals may refer to like elements throughout the specification and figures. In this regard, the present exemplary embodiments may have different forms and should not be construed as being limited to the descriptions set forth herein. Accordingly, the exemplary embodiments are merely described below in more detail with reference to the figures illustrating embodiments of the present description. As the inventive concept allows for various changes and numerous exemplary embodiments, exemplary embodiments will be illustrated in the drawings and described in detail in the written description. However, this is not intended to limit the inventive concept to particular modes of practice.

The inventive concept will now be described more fully with reference to the accompanying drawings, in which exemplary embodiments of the inventive concept are shown. FIG. 1 is a block diagram of a display apparatus 100 according to an exemplary embodiment of the present inventive concept.

Referring to FIG. 1, the display apparatus 100 may include a controller 110, a display unit 120, a gate driver 130, a data driver 140, and a backlight 150 according to an exemplary embodiment of the present inventive concept. The controller 110, the gate driver 130, and the data driver 140 may each be formed on separate semiconductor chips, or may be integrated in one semiconductor chip. In addition, the controller 110, the gate driver 130, and/or the data driver 140 may be formed on an identical substrate as the display unit 120.

In an exemplary embodiment of the present inventive concept, the display apparatus 100 may include a liquid crystal display apparatus; however, the present inventive concept is not limited thereto, and the display apparatus 100 of the present inventive concept may include various electronic devices that incorporate the use of the backlight 150 and the use of a non-light-emitting type device.

For example, the display apparatus 100 may be an electronic apparatus such as a monitor, a TV set, a smartphone, a tablet, a personal computer (PC), a notebook PC, or a display for a wearable device.

The display apparatus 100 may display a picture via a pixel P. The pixel P may include a non-light-emitting type device and/or may be a device in which transmittance of light may be controlled depending on applied current, etc. The pixel P may include a color filter that transmits an incident ray of light with a particular wavelength. The pixel P may denote one sub-pixel in the exemplary embodiment of the present inventive concept; however, the pixel P is not limited thereto, and the pixel P may denote one unit pixel including a plurality of sub-pixels. According to an exemplary embodiment of the present inventive concept, one pixel P may be interpreted as one sub-pixel or as sub-pixels included in one unit pixel.

The controller 110 may be connected to the display unit 120, the gate driver 130, the data driver 140, or the backlight 150. The controller 110 may receive either an image signal IS or an input control signal from outside of the display apparatus 100.

The image signal IS may include image data of an image to be displayed on the display unit 120. Once the image signal IS is received by the controller 110, the controller 110 may convert a format of the image data included in the image signal IS so that the data format is compatible with an interface specification with respect to the data driver 140. In addition, the controller 110 may use various image processing algorithms to generate an image for a user with a color vision deficiency, compensate the image data, and generate correction image data. For example, the controller 110 may provide the data driver 140 with image data ID corresponding to a generated correction image data.

The input control signal may be a signal including timing information related to the generation of an image on a display. The controller 110 may generate either a gate control signal CON1, a data control signal CON2, or a backlight control signal CON3 corresponding to the input control signal received by the controller 110. The previously mentioned signals will be further defined in more detail below.

In more detail, the gate control signal CON1 may, for example, include a horizontal synchronization signal, a vertical synchronization signal, a clock signal, etc. The data control signal CON2 may, for example, include the horizontal synchronization signal, the vertical synchronization signal, a data output start signal, the clock signal, etc. The backlight control signal CON3 may, for example, include a pulse width modulation (PWM) control signal, an amplitude control signal, etc. The horizontal synchronization signal may, for example, be a signal to determine a timing at which a row receiving a data signal is changed from the last row to the first row. The vertical synchronization signal may, for example, be a signal to determine a timing at which a column receiving the data signal is changed from the last column to the first column. The data output start signal may, for example, be a signal to determine a timing at which a signal, including image data, is supplied. Alternatively, the data output start signal may, for example, be a signal to determine a timing at which the data driver 140 starts to supply data signals to the display apparatus, which will be discussed in more detail later on. The PWM control signal may be a signal controlling the power supplied to the backlight 150, e.g. a signal to power on the backlight 150. Further, the control signal amplitude may be an output signal to control the amplitude of the PWM signal supplied to the backlight 150. The clock signal may be a signal to determine a timing operation of internal signals of the display apparatus 100, e.g. the clock signal may be a time when the internal signals of the display apparatus 100 are to be read or received.

The controller 110 may provide a real-time gate control signal CON1 to the gate driver 130, the data control signal CON2 to the data driver 140, and the backlight control signal CON3 to the backlight 150. Alternatively, even though not illustrated in the figures, the display apparatus 100 may separately include a backlight controller. Further, the controller 110 may output the backlight control signal CON3 to the backlight controller. In this example, the backlight controller may adjust light LIGHT emitted from the backlight 150 based on the backlight control signal CON3.

The display unit 120 may include a plurality of pixels P, a plurality of gate lines GL, and a plurality of data lines DL. Further, the plurality of gate lines GL are respectively connected to the pixels P on one column among the plurality of pixels P. The plurality of data lines DL are respectively connected to the pixels P on one row among the plurality of pixels P. The gate lines GL may extend in a column direction which may intersect the data lines DL that extend in a row direction. The gate lines GL may be electrically connected to the gate driver 130 and may supply a gate signal to the pixel P. The data lines DL may be electrically connected to the data driver 140 and may supply the data signal to the pixel P from the data driver. For example, as illustrated in FIG. 1, the pixel P may be electrically connected to corresponding gate lines GL and data lines DL, and the pixel P may receive corresponding gate signals and data signals.

The pixel P may be turned on at a time corresponding to the received gate signal, and the turned-on pixel P may transmit light of gradation corresponding to the received data signal. In this example, the pixel P may transmit light at a gradation corresponding to the received data signal by transmitting light inputted from the backlight 150 at a level corresponding to the received data signal.

In an exemplary embodiment of the present inventive concept, the gate driver 130 may output gate signals to the gate lines GL. The gate driver 130 may also output scan signals to the gate lines GL in synchronization with the vertical synchronization signal. The gate driver 130 may also sequentially supply gate signals column-by-column to the pixels P of the display unit 120.

The data driver 140 may output data signals to data lines DL in synchronization with gate signals. The data driver 140 may also output data signals corresponding to the image data inputted to the data lines DL.

The backlight 150 may be disposed on the back side of the display unit 120. The backlight 150 may emit light LIGHT to the display unit 120. In an exemplary embodiment of the present inventive concept, the backlight 150 may sequentially emit light LIGHT having different colors, relative to each other, per frame to the display unit 120. When the backlight 150 sequentially emits colors that are different from each other, the pixel P might not include the color filter. The backlight 150 may emit light LIGHT with different intensities, periods, amounts of light per unit time, and colors, all which may be in response to the backlight control signal CON3 outputted from the controller 110 or a signal outputted from the backlight controller. For example, the backlight control signal CON3 may be a signal including a command to increase the amount of light emitted per unit time. During this command, the backlight 150 emits light LIGHT per unit time, to greater than about 50%, for example, from about 50% to about 60%. In this example, the backlight 150 may increase the amount of light LIGHT emitted per unit time for the total duration of the time, to greater than about 50%, for example, from about 50% to about 60%, by increasing the amount of light that is emitted for the period of time. As a result, the intensity of light LIGHT emitted from the backlight 150 may increase by about 20%. As another example of the present inventive concept, the backlight control signal CON3 may be a signal with a command to increase the amplitude of light LIGHT emitted by the backlight 150, by about 20%.

Figure 2:
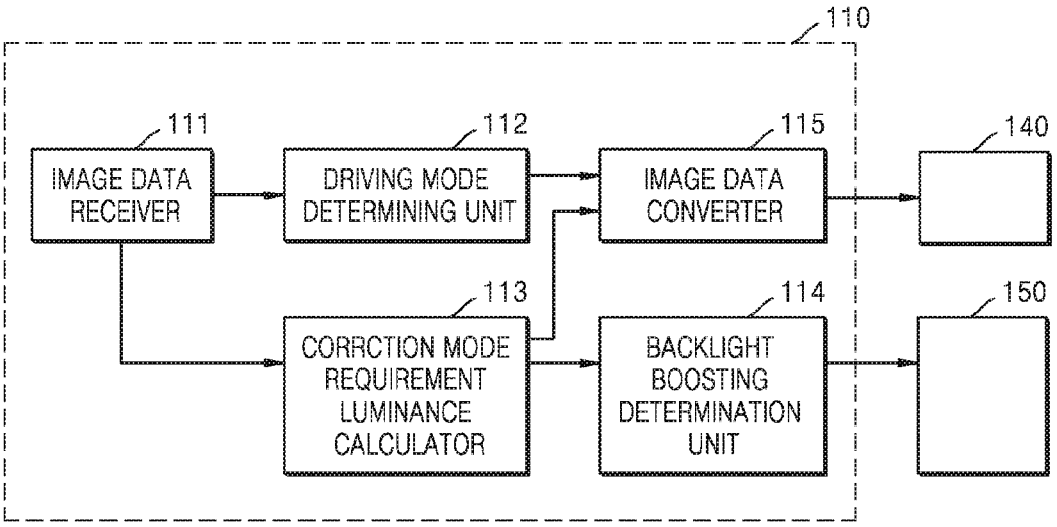
FIG. 2 is a block diagram of a display apparatus according to an exemplary embodiment of the inventive concept.

FIG. 2 is a block diagram of a display apparatus 110 according to an exemplary embodiment of the present inventive concept.

Referring to FIG. 2, the controller 110 may include an image data receiver 111, a driving mode determining unit 112, e.g. a driving mode determining controller, a correction mode requirement luminance calculator 113, a backlight boosting determination unit 114, e.g. a backlight boosting determination controller, and an image data converter 115.

The image data receiver 111 may receive image data of an image to be displayed. The image data may include colors which are accurate representations of the actual colors of the original image to be displayed. As a result, it will be understood that the image data receiver 111 receives original data of the image to be displayed.

The driving mode determining unit 112, e.g. the driving mode determining controller, may receive anomalous trichromat characteristic information of a user (e.g. user is unable to properly differentiate colors or one of the three types of cone cells is damaged), and determine a driving mode as one of a general driving mode and an anomalous trichromat correction driving mode, corresponding to the anomalous trichromat characteristic information of the user. The anomalous trichromat characteristic information of the user may include at least one of whether the user has protanomaly or deuteranomaly and the level of the anomalous trichromat. The individuals who have a color vision deficiency may have an ability to sense any color, but this ability may relatively weak and the stimulus thresholds of color sensing may be higher than that of a trichromat. The anomalous trichromat is classified into three kinds: a red-green anomalous trichromat, a blue-yellow anomalous trichromat, and a complete anomalous trichromat. The red-green anomalous trichromat is insensitive to differentiating between red color and green color. The individual with a color vision deficiency might not be able to correctly distinguish colors when lighting is dimmer, saturation is decreased, and a size of the image is smaller. In the case of the protanomaly, the ability to differentiate between red and green may significantly decrease and red may be recognized as much darker than by the trichromat, an individual with normal color vision. In addition, people suffering from this kind of color deficiency are known as anomalous trichromats. In the case of the deuteranomaly, the ability to differentiate between red and green may slightly decrease, but brightness may be recognized similar to the trichromat. A complete achromatopsia is a state in which all cone cells are anomalous and there is no ability to recognize colors. The display apparatus 100 according to an exemplary embodiment of the present embodiment may provide a display unit, a display control device, and a method of displaying an image for the user with color vision deficiency. Thus, a proper change in the original image data may be performed so that the user may be able to recognize normal colors. In exemplary embodiments of the present inventive concept, cases involving the protanomaly and the deuteranomaly will be described as examples.

The display apparatus 100 may determine whether to drive in a general driving mode or in the anomalous trichromat correction driving mode, depending on the received anomalous trichromat characteristic information of the user. For example, the controller has a driving mode determining unit 112 which may select the general driving mode when the user is a trichromat (a user without a color deficiency) and the anomalous trichromat correction driving mode when the user is suffering from a form of color vision deficiency. For example, the driving mode determining unit may use various processing algorithms to select a driving mode for the generation of an image for a user with a color vision deficiency, compensation of the image data, and generation of correction image data.

The correction mode requirement luminance calculator 113 may calculate the level of luminance of the brightest portion when the display apparatus 100 is driven in the anomalous trichromat correction driving mode, which occurs when the user has a color vision deficiency. The correction mode requirement luminance calculator 113 may calculate correction mode requirement luminance based on the anomalous trichromat characteristic information of the user. For example, the correction mode requirement luminance calculator may use various processing algorithms to calculate the level of luminance of the brightest portion when the display apparatus 100 is driven in the anomalous trichromat correction driving mode for the generation of an image for a user with a color vision deficiency, compensation of the image data, and generation of correction image data. The correction mode requirement luminance may be a luminance of the pixel P which may display the highest luminance among all the pixels P of the display unit 120 when the display apparatus 100 operates in the anomalous trichromat correction driving mode.

Further, the correction mode requirement luminance calculator 113 may calculate general mode requirement luminance necessary for an image output in the general driving mode based on the image data. The general mode requirement luminance may be luminance of the pixel P which may display an image with the highest luminance among all pixels P of the display unit 120 in the case of the general driving mode, a driving mode when the user is without a color vision deficiency. Alternatively, the general mode requirement luminance may be a luminance of a section having the highest luminance when the display unit 120 is divided into a plurality of sections. In this method, the maximum level of luminance necessary for the general driving mode may be calculated.

In an exemplary embodiment of the present inventive concept, the general mode requirement luminance may be calculated with a certain level luminance according to an exemplary embodiment of the present inventive concept. For example, the general mode requirement luminance may be a luminance of the pixel P which may have the highest luminance among all the pixels P of the display unit 120 according to a pre-arranged ranking. For example, when a total of 1,920×1,080=2,073,600 pixels P are disposed on the display unit 120, luminance of the pixel P having the $20{,}737^{th}$ highest luminance may be the general mode requirement luminance, after eliminating 1%, for example, 20,736 pixels P from the total pixels P. In this method, an algorithm in this exemplary embodiment of the present inventive concept may be practically performed even when noise in an input image, a malfunction of the display apparatus 100, etc. maybe occurring.

Then, the correction mode requirement luminance calculator 113 may calculate the correction mode requirement luminance based on the general mode requirement luminance. For example, the correction mode requirement luminance calculator 113 may calculate the correction mode requirement luminance based on the general mode requirement luminance by applying Formula 1 below;

$$L_{req2}=(a+b\times e^{c\times X})\times L_{req1}. \quad \text{[Formula 1]}$$

in which $L_{req2}$ may be the correction mode requirement luminance and $L_{req1}$ may be the general mode requirement luminance. In addition, a, b, and c may be constants to be determined depending on whether the user has the protanomaly condition or the deuteranomaly condition, and X may denote a digitized constant for anomalous trichromat information. In this case, constants a, b, and c may be determined based on the kind of anomalous trichromat, a user suffering from a kind of color blindness.

The backlight boosting determination unit 114, e.g. the backlight boosting determination controller, may determine the level of boosting light emitted from the backlight 150 corresponding to the calculated correction mode requirement luminance. In addition, there may be various methods of boosting light emitted from the backlight 150. Firstly, an intensity of light emitted from the backlight 150 may be increased so that the backlight may be boosted. In another method for example, an amount of time during which light is emitted per unit time from the backlight 150 may be increased. For example, the backlight 150 may emit light in a method in which light is repeatedly emitted and not emitted at a cycle of 30, 60, or 120 times per second. In an exemplary embodiment of the present inventive concept, the backlight 150 may emit light during a time with a value of x % in one cycle and might not emit light during a time with a value of (100−x) % in one cycle. As a result, when a value of x is increased, that is, when the amount of time during which light is emitted per unit time from the backlight 150 is increased, light emitted from the backlight 150 might be boosted.

The backlight boosting determination unit 114 may boost the backlight 150 only in the case of the anomalous trichromat correction driving mode with reference to a driving mode signal. For example, the backlight 150 may not be boosted in the case of the general driving mode.

For example, the backlight boosting determination unit 114 may determine the level of the boosting light emitted from the backlight 150 by applying Formula 2 below;

$$B=\frac{L_{req2}}{L_{req1}}, \quad \text{[Formula 2]}$$

in which B may be the level of boosting, $L_{req2}$ may be the correction mode requirement luminance, and $L_{req1}$ may be the general mode requirement luminance. In other words, the backlight boosting determination unit 114 may calculate the level of boosting the backlight 150, which is used for the display apparatus 100 to operate in the anomalous trichromat correction driving mode. A reason why the luminance required in the anomalous trichromat correction driving mode increases will be described below with reference to FIG. 3.

The backlight boosting determination unit 114 may output a boosting determine signal that denotes the level of determined boosting to the backlight 150 or the backlight controller.

The image data converter 115 may convert the image data, corresponding to the data related to the anomalous trichromat characteristic information of the user and the correction mode requirement luminance, and generate correction image data. When the driving mode determining unit 112 selects the anomalous trichromat correction driving mode, the image data converter 115 may convert the image data received from the image data receiver 111 by analyzing the anomalous trichromat characteristic information of the user and the correction mode requirement luminance. When the driving mode determining unit 112 selects the general driving mode, the image data converter 115 might not convert the image data, or the image data converter 115 may generate the image data substantially identical with the image data received by the image data receiver 111. The image data converter 115 may output a data signal, corresponding to the correction image data, to the data driver 140.

The image data converter 115 may store at least one correction matrix for converting the image data. The image data converter may also store at least one correction matrix to generate the correction image data from the image data by utilizing at least one correction matrix, corresponding to the anomalous trichromat characteristic information of the user.

For example, the image data converter 15 may generate the correction image data from the image data by applying Formula 3 below;

$$\begin{bmatrix} R_o \\ G_o \\ B_o \end{bmatrix} = \frac{X}{255}\cdot[T]\cdot\begin{bmatrix} R_i \\ G_i \\ B_i \end{bmatrix}, \quad \text{[Formula 3]}$$

in which X may be a first correction factor and T may be the correction matrix. $R_i$, $G_i$, and $B_i$ may be the image data, and $R_o$, $G_o$, and $B_o$ may be the correction image data. The correction matrix may assist the user with a color vision deficiency in recognizing colors as recognized by the trichromat (a user without a color vision deficiency), by converting the image data received by the image data receiver 111 and emphasizing the differences between colors for which the differentiation is difficult and other colors.

Further, for example, the image data converter 115 may determine a first correction factor by applying Formula 4 below;

$$X = \left|255 \times \left(\frac{1}{B}\right)^{1/\gamma}\right|, \quad \text{[Formula 4]}$$

in which B may refer to the level of boosting and γ may refer to a gamma value. In more detail, a change in a gray level used in a conventional image signal (for example, an RGB signal) might not be linearly equal to a change in the intensity of light recognized by a human being. For example, the intensity of light at a gray level of 100 might not be double the intensity of light at a gray level of 50. Further, the gamma correction value is equal to a conversion of a value, which linearly changes depending on a change in the intensity of light, to the gray level. An inverse multiplier used in such a process may be the gamma. The gamma may generally have a value of about 2.2.

The image data converter 115 may increase an amount of light emitted from the backlight 150 and generally decrease the image data of an image for the user with a color vision deficiency by replicating the level of increase in the amount of light, when the image for the user is generated. A reason why the image data is generally reduced in the image for the user will be described below with reference to FIG. 3.

FIG. 3 is a table of a correction matrix according to an exemplary embodiment of the present inventive concept.

As described above with reference to FIG. 2 and Formula 3, the image data converter 115 may provide the user with a color vision deficiency by utilizing a correction matrix so that the user may recognize colors as the trichromat does, the individual without a color vision deficiency.

For example, the correction matrix may be an inverse Daltonize matrix. The Daltonize matrix may convert colors recognized by the trichromat to colors recognized by the user with a color vision deficiency so that the trichromat may indirectly experience colors similar to those recognized by the user with a color vision deficiency. Thus, when the Daltonize matrix is applied to color data of the original image, an image converted to colors that the user with a color vision deficiency recognizes may be viewed.

The correction matrix illustrated in FIG. 3 is an example of an inverse matrix of the Daltonize matrix. Further, as illustrated in FIG. 3 a left matrix is a matrix applied to the protanomaly and a right matrix is a matrix applied to the deuteranomaly. In addition, a vertical axis denotes the level of the anomalous trichromat and as the number increases from 0, the level of the anomalous trichromat becomes severer. Thus, when the level of the anomalous trichromat is 0, a case of the trichromat is indicated. Further, the image data received by the image data receiver 111 might not be changed and the correction matrix may be applied thereto. In addition, as the level of the anomalous trichromat reaches 1, it will be understood that the level is close to achromatopsia, which is a visual disorder which is characterized by decreased vision, light sensitivity, and the absence of color vision.

As described above, in the case of the protanomaly, a capability of differentiating between red and green may be lower than that of the trichromat. The matrix applied to the case of the protanomaly among correction matrices, as illustrated in FIG. 3, may convert the inputted image data so that the protanomal may easily differentiate between red and green.

Below is an example of a case in which the image data includes three values of data with each value referring red, green, or blue. For example, when three respective values of the image data may be 160, 110, and 100 and the level of the anomalous trichromat of the user with the protanomaly is 0.1, the correction matrix to be applied thereto may be a matrix below:

$$\begin{bmatrix} 1.176 & -0.224 & 0.048 \\ -0.036 & 1.054 & -0.018 \\ 0.003 & 0.001 & 0.996 \end{bmatrix}.$$

In this example demonstrated below, the correction image data generated by the correction matrix may be 168.32, 108.38, and 100.19, respectively.

$$\begin{bmatrix} 1.176 & -0.224 & 0.048 \\ -0.036 & 1.054 & -0.018 \\ 0.003 & 0.001 & 0.996 \end{bmatrix} \times \begin{bmatrix} 160 \\ 110 \\ 100 \end{bmatrix} = \begin{bmatrix} 168.32 \\ 108.38 \\ 100.19 \end{bmatrix}$$

The difference in R and G values in the image data may be about 50 and in the correction image data may be about 59.94.

In an example, the image data includes 160, 110, and 100, as above, and the level of the anomalous trichromat of the user with the protanomaly is 0.2, the correction matrix to be applied thereto may be a matrix below:

$$\begin{bmatrix} 1.398 & -0.509 & 0.111 \\ -0.079 & 1.117 & -0.037 \\ 0.006 & 0.002 & 0.991 \end{bmatrix}.$$

In this example demonstrated below, the correction image data generated by the correction matrix may be 178.79, 106.53, and 100.28, respectively.

$$\begin{bmatrix} 1.398 & -0.509 & 0.111 \\ -0.079 & 1.117 & -0.037 \\ 0.006 & 0.002 & 0.991 \end{bmatrix} \times \begin{bmatrix} 160 \\ 110 \\ 100 \end{bmatrix} = \begin{bmatrix} 178.79 \\ 106.53 \\ 100.28 \end{bmatrix}$$

In this example, the difference between R and G values in the correction image data may be about 72.26.

As the level of the protanomaly becomes severer, the capability of differentiating between red and green may further decrease, and thus, it is necessary to make the difference between the values of red and green even larger by implementing the correction matrix. In the example, the difference between R and G values in the image data is about 50, and when levels of the anomalous trichromat are 0.1 and 0.2, the differences between R and G values in the correction image data increase to 59.94 and 72.26, respectively.

Accordingly, the user with the protanomaly may easily differentiate between red and green in the image displayed by using the correction image data.

So far, a case in which the R value is larger than G value in the image data has been described; however, a substantially identical method may be applied to an example in which the G value is larger than R value.

For example, when the image data includes 100, 180, and 120, and the level of the user with the protanomaly is 0.1, the correction matrix to be applied may be a matrix as illustrated below:

$$\begin{bmatrix} 1.176 & -0.224 & 0.048 \\ -0.036 & 1.054 & -0.018 \\ 0.003 & 0.001 & 0.996 \end{bmatrix}.$$

In this example, the correction image data generated by the correction matrix may be 83.04, 183.96, and 120, respectively.

The difference between R and G values in the image data may be about 80 and the difference in the correction image data may be about 100.92. Thus, since the color difference between red and green in the correction image data becomes larger than the difference between red and green in the image data, the user with the protanomaly may easily differentiate red and green in the image displayed by utilizing the generated correction image data.

When the image data does not include a high gradation, the process of generating an image for the protanomaly by the utilization of an inverse matrix of the Daltonize matrix may be performed without a problem. However, when the image data includes a high gradation, a value may be generated which exceeds the maximum gradation displayable by the pixel P.

For example, when the image data includes 255, 180, and 100, and the level of the user with the protanomaly is 0.1, 264.36, 182.34, and 100.545 are generated as the correction image data. Further, with regard to the above example the difference between the R and G values becomes even larger so that the user may more easily differentiate between red and green. However, since the R value of the correction image data is 264.36, which exceeds 255, it is necessary to correct the R value of the correction image data by decreasing its value to less than 255.

The correction image data, which is less than the maximum gradation and the gradation displayable by the pixel P, may be obtained by multiple methods: the calculation of the correction mode requirement luminance using Formula 1; the calculation of the level of boosting using Formula 2; and the correction of the image data using Formulas 3 and 4 by substantially replicating the calculated boosting level.

In more detail, factors in Formula 1, used to calculate the correction mode requirement luminance, may be calculated by using the following: (1) whether the user has values related to protanomaly or values related to deuteranomaly, depending on which color vision deficiency the user has, or (2) the level of the anomalous trichromat. For example, when the user has the protanomaly, the correction mode requirement luminance may be calculated by applying Formula 5, which is obtained with reference to FIG. 2, below:

$$L_{req2}=(0.6306+0.3884\times e^{(0.3286\times 10S)})\times L_{req1}, \quad \text{[Formula 5]}$$

in which S may denote the level of the anomalous trichromat. Similarly, when the user has the deuteranomaly, the correction mode requirement luminance may be calculated by applying Formula 6, which is obtained with reference to FIG. 2, below:

$$L_{req2}=(0.5247+0.4817\times e^{(0.2799\times 10S)})\times L_{req1}, \quad \text{[Formula 6]}$$

in which S may denote the level of the anomalous trichromat. For example, as described above, when the user has the protanomaly and the level of the anomalous trichromat is 0.1, the correction mode requirement luminance may be calculated by substituting S with 0.1. After applying the substitution of 0.1 in Formula 5, the correction mode requirement luminance ($L_{req2}$) may be calculated, and then that value may be substituted into Formula 2. Further, after the correction mode requirement luminance substitution, the level of the boosting (B) light of the backlight 150 may be obtained as equaling about 1.17.

For example, when the level of boosting obtained as such is substituted into Formulas 3 and 4 and the image data is corrected, the correction image data may be 246.15, 169.78, and 93.62. For example, since the correction image data corrected by applying Formulas 1 through 4 are composed of values less than the maximum gradation that is displayable by the pixel P, the problem which may occur in the case of the high gradation may be solved.

When only the amount of light transmitted by the pixel P was adjusted in the past, it was impossible to present the image to the user with a color vision deficiency by applying the inverse matrix of the Daltonize matrix, and even if it was possible to present that, there was a problem of generating an image with a decreased luminance. The display apparatus 100 may provide the image for the user with a color vision deficiency without problems, such as by decreased luminance via the inverse matrix of the Daltonize matrix, and an increase in the amount of light emitted via the backlight 150 when displaying the image for the user according to the content of the present inventive concept.

Figure 4:
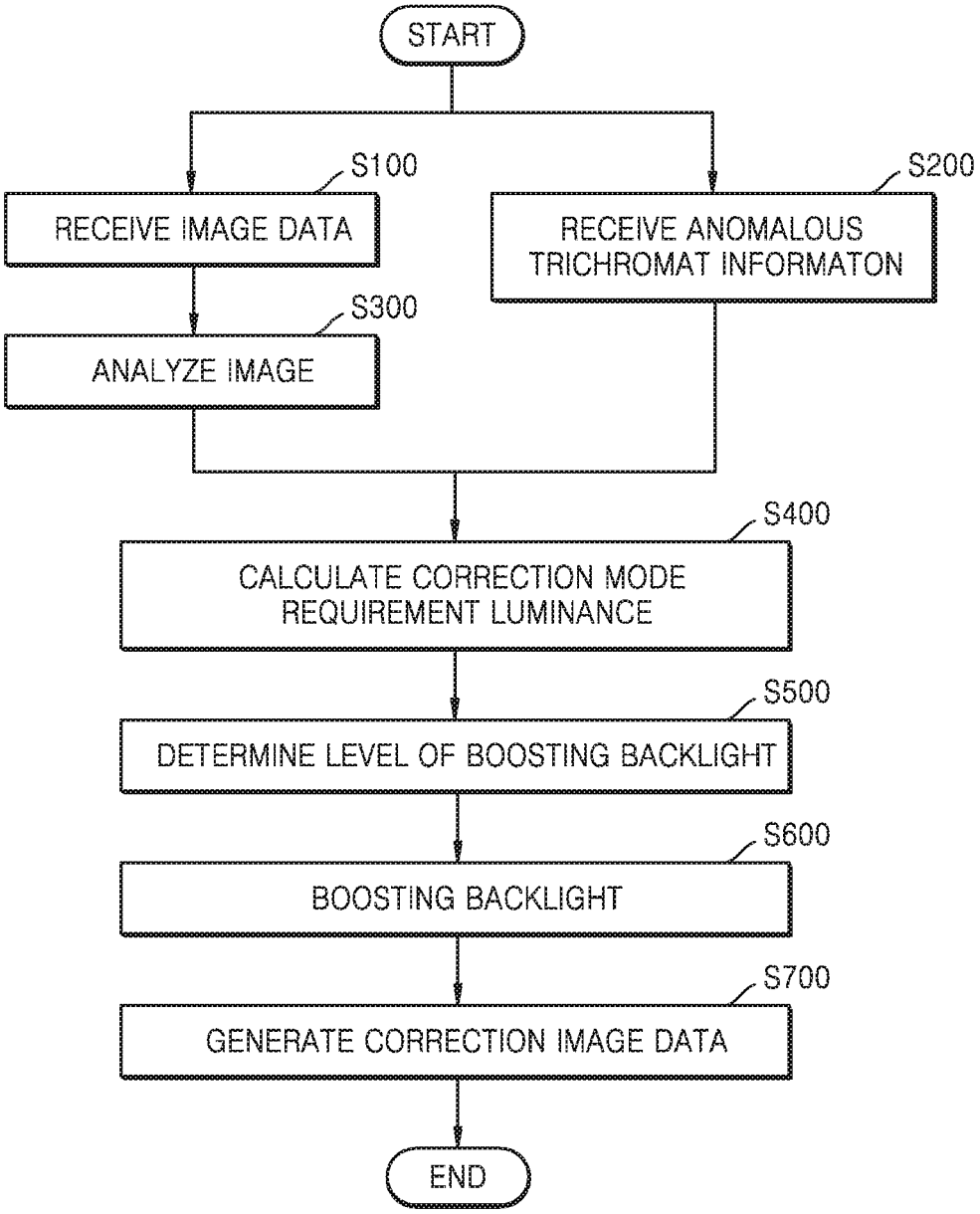
FIG. 4 is a flowchart of an operation algorithm of the display apparatus according to an exemplary embodiment of the inventive concept.

An operation algorithm according to an exemplary embodiment of the present inventive concept is described with reference to FIG. 4. FIG. 4 is a flowchart of an operation algorithm of the display apparatus 100 according to an exemplary embodiment of the present inventive concept. Below, duplicate descriptions on content similar to examples illustrated in FIGS. 1 through 3 will be omitted.

Referring to FIG. 4, the display apparatus 100 may perform receiving image data (operation S100) and receiving anomalous trichromat information (operation S200) according to an exemplary embodiment of the present inventive concept. The image data may be, for example, RGB image data including image data of red, green, and blue. The anomalous trichromat information may include information about whether a user has protanomaly, deuteranomaly or trichromat, and information about values representing the level of the anomalous trichromat when the user has a color vision deficiency.

Next, the display apparatus 100 may analyze the received image data (operation S300). In operation S300, the display apparatus 100 may calculate the general mode requirement luminance which is the maximum luminance necessary for displaying the corresponding image in the general driving mode.

Next, the display apparatus 100 may calculate the correction mode requirement luminance (operation 8400). In operation 8400, the display apparatus 100 may calculate the correction mode requirement luminance based on the general mode requirement luminance and the anomalous trichromat information.

Next, the display apparatus 100 may determine the level of boosting of the backlight 150 to perform (operation 8500). For example, since calculations of the general mode requirement luminance and the correction mode requirement luminance have been complete, the display apparatus 100 may calculate the approximate level of boosting the backlight 150 by applying Formulas described with reference to FIGS. 1 through 3. The level of boosting may include information about how to adjust the PWM signal, with regard to detail, applied to the backlight 150 or may include information about simply increasing the amount of light by a certain amount or by a certain percentage.

Next, the display apparatus 100 may perform the boosting of the backlight 150 (operation S600).

Next, the display apparatus 100 may generate the correction image data (operation 8700). The display apparatus 100 may generate the correction image data by taking into account the level of boosting. For example, the display apparatus 100 may do the following: generate the image data for the user with a color vision deficiency by applying the inverse matrix of the Daltonize matrix; make a correction on values of the generated image data for the user by taking into account the level of boosting the backlight 150; and output the image with certain colors emphasized without causing a luminance difference from a general image.

Referring to FIG. 2 again, before determining the level of boosting corresponding to the correction mode requirement luminance, the backlight boosting determination unit 114 may compare the correction mode requirement luminance with a first reference value. In this example, the first reference value may be the maximum luminance that may be output by the pixel P in the general driving mode. As a result, the first reference value may be a luminance of light emitted from the display apparatus 100 when the gradation value allowed to the pixel P is the maximum in the general driving mode (for example, the maximum gradation value is 255 in the case of 8-bit image data, and the maximum gradation value is 1,023 in the case of 10-bit image data).

In more detail, when light emitted by the backlight 150 is excessive, a lifetime of the backlight 150 may be affected and a malfunction of the backlight 150 may occur. In addition, temperature of the backlight 150 itself or the display apparatus 100 may increase due to excessive light being emitted and various side effects may occur therefrom. Thus, the backlight boosting determination unit 114 may increase luminance of the image by activating the pixel P up to the maximum of the amount of light that the pixel P may transmit, and may increase light emitted from the backlight 150 for the level that might not be solely achieved by the pixel P.

To this end, the backlight boosting determination unit 114 may determine the level of the boosting light via, for example, Formula 7:

$$B = \frac{L_{req2}}{L_{max}}, \qquad \text{[Formula 7]}$$

in which B may be the level of boosting, $L_{req2}$ may be the correction mode requirement luminance, and $L_{max}$ may be the maximum luminance that may be output by the pixel P in the general driving mode. For example, when the correction mode requirement luminance is higher than the maximum luminance that may be output by the pixel P in the general driving mode, the backlight boosting determination unit 114 may determine the level of boosting such that the level corresponding to the difference only is compensated via the backlight 150. Thus, the backlight boosting determination unit 114 may determine the level of boosting by the backlight 150 to compensate for the difference between required luminance and maximum output luminance by the pixel P.

In this case, the image data converter 115 may generate the correction image data via, for example, Formula 8:

$$\begin{bmatrix} R_o \\ G_o \\ B_o \end{bmatrix} = \frac{Y}{255} \cdot [T] \cdot \begin{bmatrix} R_i \\ G_i \\ B_i \end{bmatrix}, \qquad \text{[Formula 8]}$$

in which Y may be a second correction factor and T may be the correction matrix. $R_i$, $G_i$, and $B_i$ may be the image data, and $R_o$, $G_o$, and $B_o$ may be the correction image data. The second correction factor may be calculated via, for example, Formula 9 below;

$$Y = \left| 255 \times \left( \frac{L_{req1}}{L_{max}} \right)^{1/\gamma} \right| \qquad \text{[Formula 9]}$$

Thus, when the correction image data calculated by using the correction matrix includes the gradation value in need of the maximum luminance that may be output by the pixel P, the image data converter 115 may modify the corresponding value to the maximum gradation value applicable to the pixel P.

In this method, the display apparatus 100 may increase luminance of the image by activating the pixel P up to the maximum of the amount of light that the pixel P may transmit, and may increase light emitted from the backlight 150 for the level that may not solely be achieved with the pixel P.

Figure 5:
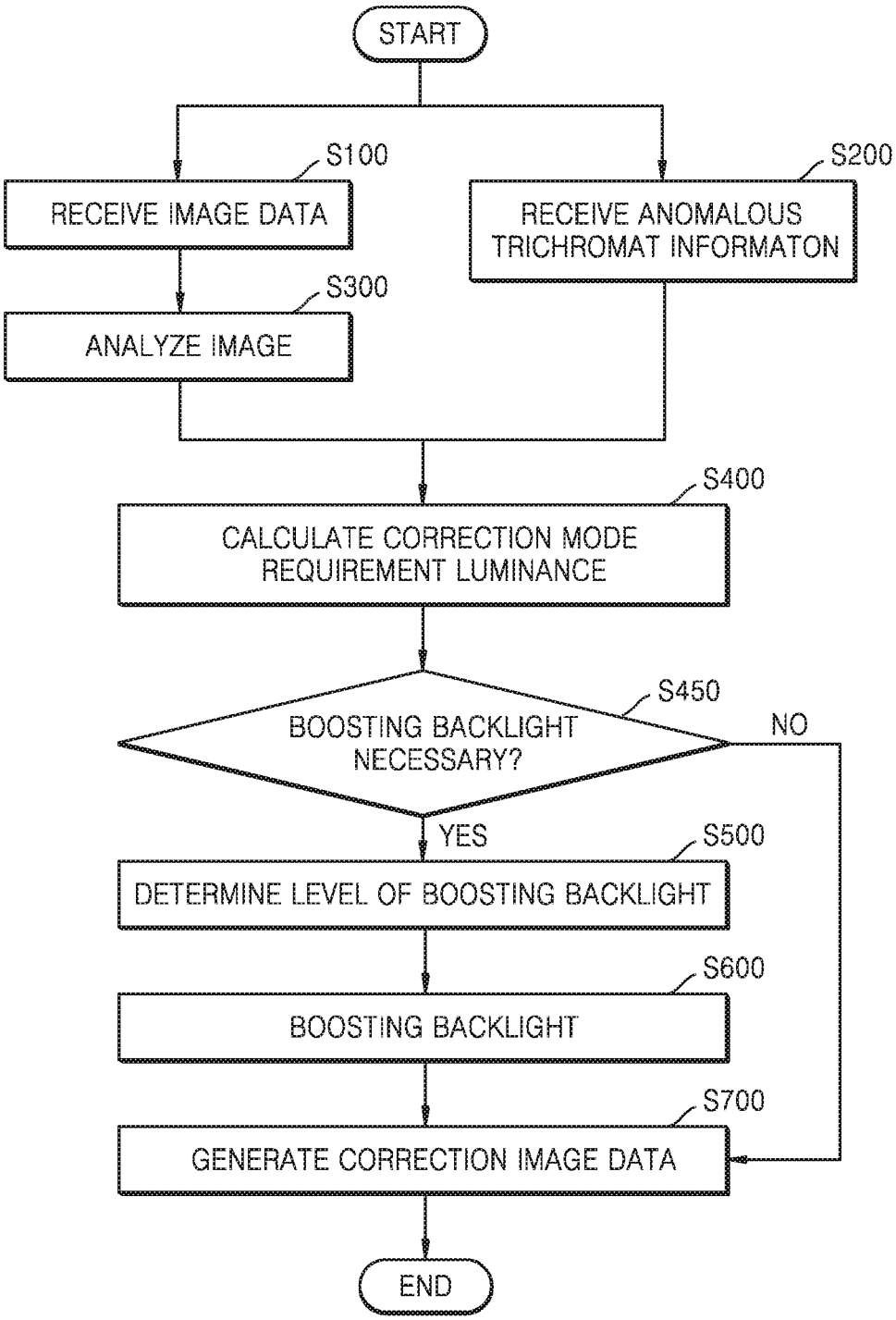
FIG. 5 is a flowchart of an operation algorithm of the display apparatus according to an exemplary embodiment of the inventive concept.

The operation algorithm according to an exemplary embodiment of the present inventive concept will be described with reference to FIG. 5. FIG. 5 is a flowchart illustrating an operation algorithm of the display apparatus 100 according to an exemplary embodiment of the present inventive concept. Below, duplicate descriptions on content similar to examples illustrated in FIGS. 1 through 4 will be omitted.

Referring to FIG. 5, the display apparatus 100 may perform receiving the image data (operation S100), receiving the anomalous trichromat information (operation S200), analyzing the image (operation S300), and calculating the correction mode requirement luminance (operation S400) according to an exemplary embodiment of the present inventive concept.

Next, the display apparatus 100 may determine whether the boosting of the backlight 150 is necessary (operation S450). The display apparatus 100 may determine the necessity of the boosting of the backlight 150 based on whether the correction mode requirement luminance exceeds the maximum luminance that may be output by the pixel P in the general driving mode. When the correction mode requirement luminance exceeds the maximum luminance that may be output by the pixel P in the general driving mode, the display apparatus 100 may determine that the boosting the backlight 150 is necessary, and may determine the level of boosting the backlight 150 by applying Formula 7. When the correction mode requirement luminance is less than the maximum luminance that may be output via the pixel P in the general driving mode, the display apparatus 100 may determine that the boosting the backlight 150 is not necessary, and may omit the boosting the backlight 150. In this exemplary embodiment of the present inventive concept, the backlight boosting determination unit 114 of the display apparatus 100 might not output any signal, or the display apparatus 100 may output the boosting determine signal with the level of boosting at about 0 or about 0%.

When the boosting the backlight 150 is determined to be necessary, the display apparatus 100 may determine the level of boosting the backlight 150 (operation 8500), boost the backlight 150 (operation S600), and generate the correction image data (operation 8700). When the boosting the backlight 150 is determined to be unnecessary, the display apparatus 100 may omit operations related to the boosting of the backlight 150 and may generate the correction image data (operation S700).

In this exemplary method of the present inventive concept, the display apparatus 100 may output the image with certain colors emphasized, without the luminance difference from the general image, and may minimize the level of boosting of the backlight 150.

Figure 6:
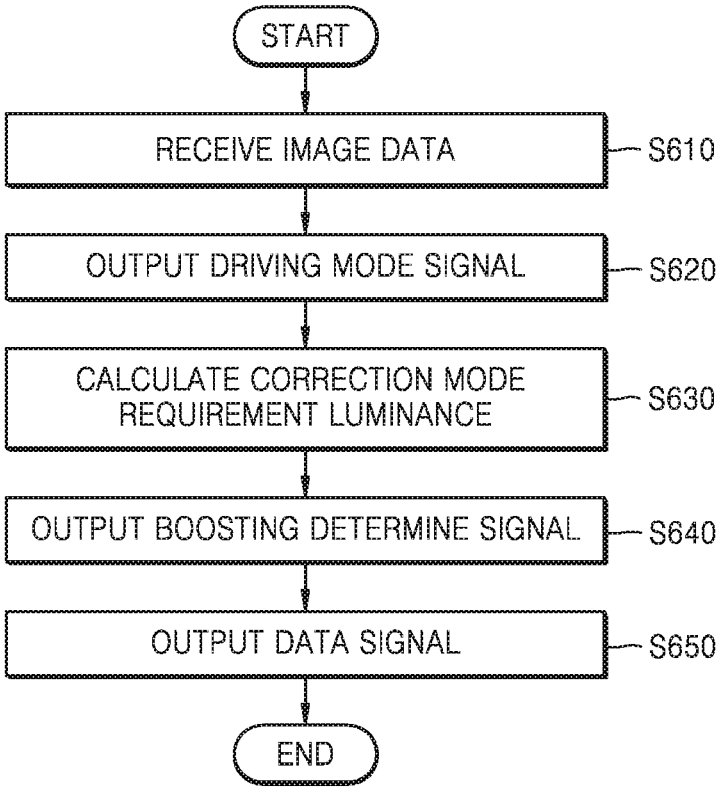
FIG. 6 is a flowchart of a method of driving the display apparatus according to an exemplary embodiment of the inventive concept.

FIG. 6 is a flowchart illustrating a method of driving the display apparatus 100 according to an exemplary embodiment of the present inventive concept. Below, duplicate descriptions on content similar to examples illustrated in FIGS. 1 through 5 will be omitted.

Referring to FIG. 6, the display apparatus 100 may be driven by performing an operation of receiving the image data (operation S610). The image data may be data for the image to be displayed via the display apparatus 100.

Next, the display apparatus 100 may be driven by outputting the driving mode signal (operation S620). The driving mode signal may be a signal indicating a desired mode of operation for example, a general driving mode or the anomalous trichromat correction driving mode.

Next, the display apparatus 100 may be driven by performing an operation of calculating the correction mode requirement luminance (operation S630). The correction mode requirement luminance may be the maximum luminance that may be output when the display apparatus 100 is driven in the anomalous trichromat correction driving mode. Such correction mode requirement luminance may be calculated based on the anomalous trichromat characteristic information of the user and the image data.

Next, the display apparatus 100 may be driven by outputting the boosting determine signal (operation S640). The boosting determine signal may include the level of boosting which may refer to the level of increase in light emitted via the backlight 150. The level of boosting may be calculated based on the correction mode requirement luminance.

Next, the display apparatus 100 may be driven by outputting the data signal (operation S650). The data signal may be calculated based on the anomalous trichromat characteristic information of the user and the correction mode requirement luminance.

The display apparatus 100 including the backlight 150 may display the image for the user with a color vision deficiency without a reduction in luminance according to an embodiment.

While one or more embodiments have been described with reference to the figures, it will be understood by those of ordinary skill in the art that various changes in form and details may be made therein.

What is claimed is:

1. A display apparatus comprising:

an image data receiver receiving image data of an image to be displayed;

a driving mode determining controller receiving anomalous trichromat data of a user, determining a driving mode as either a general driving mode or an anomalous trichromat correction driving mode, based on the anomalous trichromat data of the user, and outputting a driving mode signal indicative of the determination;

a correction mode requirement luminance calculator calculating a correction mode requirement luminance for an image output for the user, wherein the correction mode requirement luminance corresponds to the anomalous trichromat data of the user and the image data;

a backlight boosting determination controller determining a level of boosting light emitted from a backlight, corresponding to the correction mode requirement luminance, and outputting a boosting determine signal;

an image data converter converting image data corresponding to the anomalous trichromat data of the user and the correction mode requirement luminance, and outputting a data signal corresponding to correction image data;

the backlight emitting light having an intensity corresponding to the driving mode signal and the boosting determine signal; and a pixel transmitting a quantity of light according to the data signal.

2. The display apparatus of claim 1, wherein the anomalous trichromat data of the user comprises whether the user has protanomaly or deuteranomaly, or the level of the anomalous trichromat.

3. The display apparatus of claim 1, wherein the correction mode requirement luminance calculator calculates the general mode requirement luminance for the image output in the general driving mode, based on the image data, and calculates the correction mode requirement luminance based on the general mode requirement luminance.

4. The display apparatus of claim 3, wherein the correction mode requirement luminance calculator calculates the correction mode requirement luminance by applying the formula, $$L_{req2}=(a+b\times e^{c\times X})\times L_{req1},$$

wherein $L_{req2}$ is the correction mode requirement luminance, $L_{req1}$ is the general mode requirement luminance, a, b, and c are values determined based on whether the user has the protanomaly or the deuteranomaly, and X denotes a digitized constant for anomalous trichromat information.

5. The display apparatus of claim 1, wherein the backlight boosting determination controller determines the level of boosting by applying the formula, $$B=\frac{L_{req2}}{L_{req1}},$$

wherein B is the level of boosting, $L_{req2}$ is the correction mode requirement luminance, and $L_{req1}$ is the general mode requirement luminance.

6. The display apparatus of claim 1, wherein the image data converter stores at least one correction matrix for converting the image data, and generates the correction image data from the image data by utilizing the correction matrix, corresponding to the anomalous trichromat data of the user.

7. The display apparatus of claim 6, wherein the correction matrix is an inverse matrix of a Daltonize matrix.

8. The display apparatus of claim 6, wherein the image data converter generates the correction image data from the image data by applying the formula, $$\begin{bmatrix} R_o \\ G_o \\ B_o \end{bmatrix} = \frac{X}{255} \cdot [T] \cdot \begin{bmatrix} R_i \\ G_i \\ B_i \end{bmatrix},$$

wherein X is a first correction factor and T is the correction matrix, $R_i$, $G_i$, and $B_i$ are the image data, and $R_o$, $G_o$, and $B_o$ are the correction image data.

9. The display apparatus of claim 8, wherein the first correction factor X is calculated by applying the formula, $$X = \left| 255 \times \left( \frac{1}{B} \right)^{1/\gamma} \right|,$$

wherein B is the level of boosting and γ denotes a gamma value.

10. The display apparatus of claim 1, wherein the backlight boosting determination controller outputs a boosting determine signal after determining the level of intensity of the boosting light emitted from the backlight, corresponding to the correction mode requirement luminance, when the correction mode requirement luminance exceeds a first reference value, and outputs the boosting determine signal to omit the boosting light emitted from the backlight when the correction mode requirement luminance is less than the first reference value.

11. The display apparatus of claim 10, wherein the first reference value comprises the maximum luminance that the pixel in the general driving mode transmits.

12. The display apparatus of claim of 10, wherein the image data converter generates the correction image data from the image data by applying the formula, $$\begin{bmatrix} R_o \\ G_o \\ B_o \end{bmatrix} = \frac{Y}{255} \cdot [T] \cdot \begin{bmatrix} R_i \\ G_i \\ B_i \end{bmatrix},$$

wherein Y is a second correction factor and T is the correction matrix and $R_i$, $G_i$, and $B_i$ are the image data, and $R_o$, $G_o$, and $B_o$ are the correction image data.

13. The display apparatus of claim 12, wherein the second correction factor Y is calculated by applying the formula, $$Y = \left| 255 \times \left( \frac{L_{req1}}{L_{max}} \right)^{1/\gamma} \right|,$$

wherein $L_{req1}$ is the general mode requirement luminance, $L_{max}$ is the maximum luminance that the pixel in the general driving mode transmits, and Y denotes the gamma value.

14. The display apparatus of claim 10, wherein the backlight boosting determination controller determines the level of boosting, when the correction mode requirement luminance exceeds the first reference value, by applying the formula, $$B = \frac{L_{req2}}{L_{max}},$$

wherein B is the level of boosting, $L_{req2}$ is the correction mode requirement luminance, and $L_{max}$ is the maximum luminance that the pixel in the general driving mode transmits.

15. A method of driving a display apparatus, the method comprising:

receiving image data of an image to be displayed;

receiving anomalous trichromat data of a user, determining a driving mode as either a general driving mode or an anomalous trichromat correction driving mode, based on the anomalous trichromat data of the user;

outputting a driving mode signal indicative of the determination;

calculating a correction mode requirement luminance for an image output for the user, wherein the correction mode requirement luminance corresponding corresponds to the anomalous trichromat data of the user and the image data;

determining the level of boosting light emitted from a backlight, corresponding to the correction mode requirement luminance;

outputting a boosting determine signal;

converting image data corresponding to the anomalous trichromat data of the user and the correction mode requirement luminance; and outputting a data signal corresponding to correction image data.

16. The method of claim 15, wherein the anomalous trichromat data of the user comprises whether the user has protanomaly or deuteranomaly or the level of the anomalous trichromat.

17. The method of claim 15, wherein the calculating the correction mode requirement luminance comprises:

calculating the general mode requirement luminance for the image output in the general driving mode, based on the image data; and calculating the correction mode requirement luminance, based on the general mode requirement luminance.

18. The method of claim 17, wherein the calculating the correction mode requirement luminance comprises calculating the correction mode requirement luminance by applying the formula, $$L_{req2} = (a + b \times e^{c \times X}) \times L_{req1},$$

wherein $L_{req2}$ is the correction mode requirement luminance, $L_{req1}$ is the general mode requirement luminance, and a, b, and c are values determined based on whether the user has protanomaly or deuteranomaly, and X denotes a digitized constant for anomalous trichromat information.

19. The method of claim 15, wherein the outputting the boosting determine signal comprises outputting the boosting determine signal comprising information about the level of boosting by applying the formula, $$B = \frac{L_{req2}}{L_{req1}},$$

wherein B is the level of boosting, $L_{req2}$ is the correction mode requirement luminance, and $L_{req1}$ is the general mode requirement luminance.

20. The method of claim 19, wherein the outputting the data signal comprises generating the correction image data from the image data by applying the formula, $$\begin{bmatrix} R_o \\ G_o \\ B_o \end{bmatrix} = \frac{X}{255} \cdot [T] \cdot \begin{bmatrix} R_i \\ G_i \\ B_i \end{bmatrix},$$

wherein X is a first correction factor and T is the correction matrix, $R_i$, $G_i$, and $B_i$ are the image data, and $R_o$, $G_o$, and $B_o$ are the correction image data.

* * * * *